US007097330B1

(12) United States Patent
Straus et al.

(10) Patent No.: US 7,097,330 B1
(45) Date of Patent: Aug. 29, 2006

(54) OUTDOOR LIGHTING FIXTURE

(75) Inventors: Joseph Straus, Encino, CA (US); Angel Orellana, Los Angeles, CA (US); Henry Avila, Palmdale, CA (US); Luis Romero, Palmdale, CA (US); Tim Carraher, Palmdale, CA (US)

(73) Assignee: U.S. Pole Company, Inc., Palmdale, CA (US)

( * ) Notice: Subject to any disclaimer, the term of this patent is extended or adjusted under 35 U.S.C. 154(b) by 0 days.

(21) Appl. No.: 10/923,266

(22) Filed: Aug. 19, 2004

Related U.S. Application Data

(60) Provisional application No. 60/496,632, filed on Aug. 19, 2003, provisional application No. 60/496,633, filed on Aug. 19, 2003.

(51) Int. Cl.
*F21V 23/00* (2006.01)

(52) U.S. Cl. ..... 362/368; 362/147; 362/152; 362/153.1; 362/362; 362/649; 362/365; 362/431; 362/432

(58) Field of Classification Search ..... 362/368, 362/145, 147, 152, 153, 153.1, 640, 362, 362/364, 365, 431, 432, 649
See application file for complete search history.

(56) References Cited

U.S. PATENT DOCUMENTS 4,384,316 A * 5/1983 de Vos et al. ..... 362/147
5,941,632 A * 8/1999 Wedell et al. ..... 362/410

* cited by examiner

*Primary Examiner*—Sharon Payne
(74) *Attorney, Agent, or Firm*—Christie, Parker & Hale, LLP.

(57) ABSTRACT

A component carrying tray is removably mounted in a luminaire housing. The luminaire housing has a pair of thumb screws that fit in a pair of key holes shaped opening in the tray so the tray can be removed with one hand. To disengage the tray, a maintenance person simply loosens the thumb screws one quarter turn to align them with the holes, lifts the tray off the thumb screws with one hand, and then pulls the tray out of luminaire housing.

10 Claims, 1 Drawing Sheet

OUTDOOR LIGHTING FIXTURE

CROSS-REFERENCE TO RELATED APPLICATION(S)

This application claims the priority of provisional patent application 60/496,632, filed Aug. 19, 2003 and 60/496,633, filed Aug. 19, 2003, both of which are incorporated fully herein by reference.

BACKGROUND OF THE INVENTION

This invention relates to an outdoor luminaire having an easily removable component carrying tray to facilitate maintenance of the luminaire.

Luminaires generally have a ballast/transformer and a capacitor to boost the line voltage. In addition, other electrical components are sometimes also provided. From time to time the components require replacement. Since the luminaires are usually mounted on poles, they can not be accessed from the ground. Maintenance of the luminaires is thus a difficult and sometimes dangerous task.

SUMMARY OF THE INVENTION

To facilitate servicing of outdoor luminaires, the invention provides an easily removeable component carrying tray. Preferably, the luminaire is designed so the component carrying tray can be removed by a maintenance person with one hand in the absence of any tools.

According to the invention, a component carrying tray is removably mounted in a luminaire housing. The luminaire housing has a pair of thumb screws that fit in a pair of key holes shaped opening in the tray so the tray can be removed with one hand. To disengage the tray, a maintenance person simply loosens the thumb screws one quarter turn to align them with the holes, lifts the tray off the thumb screws with one hand, and then pulls the tray out of the luminaire housing.

DETAILED DESCRIPTION OF THE INVENTION

Figure 1:
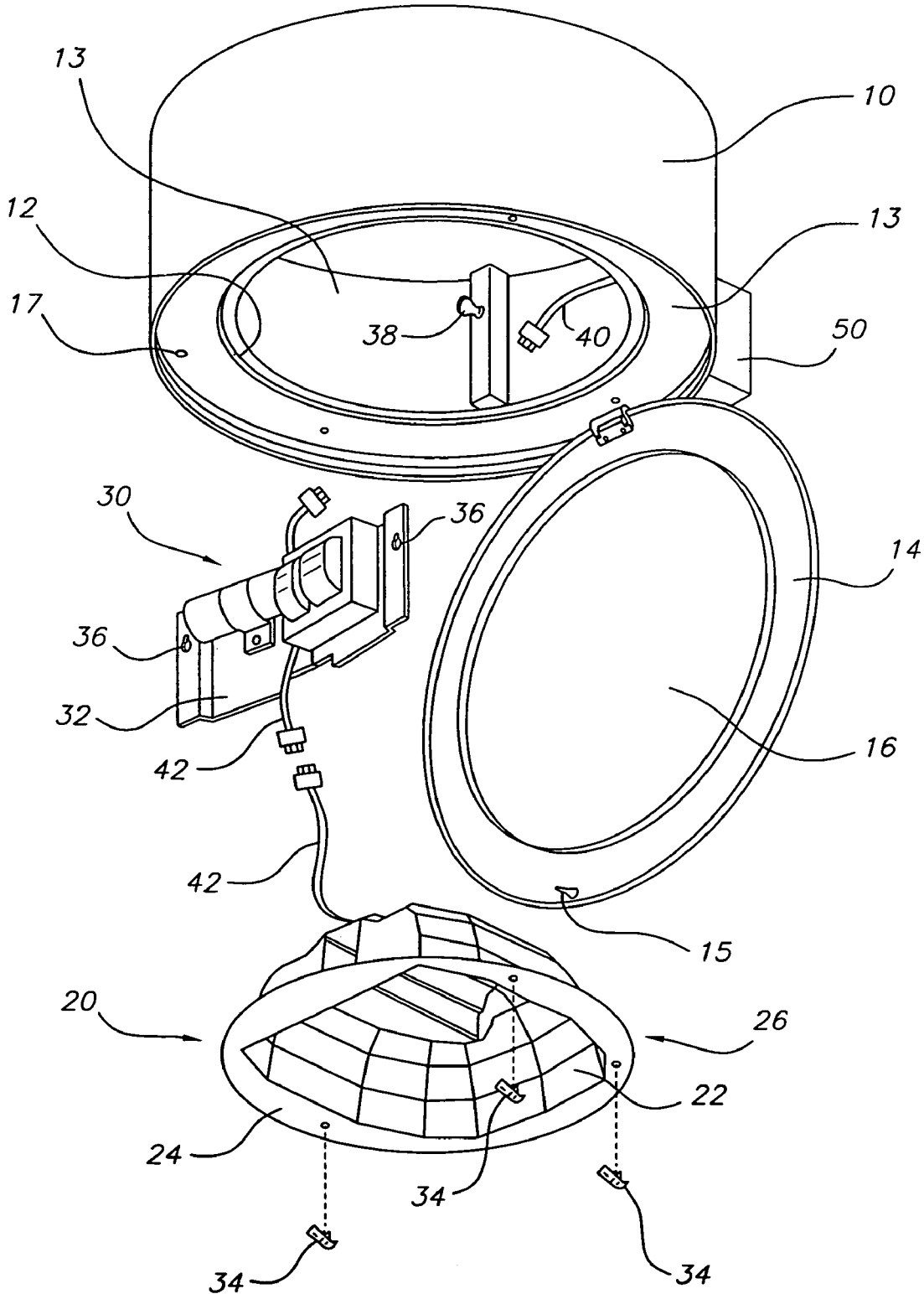
FIG. 1 is a perspective exploded view of a luminaire incorporating the principles of the invention.

In FIG. 1 an outdoor lighting fixture, sometimes called a luminaire, has a cylindrical housing 10, preferably made of sheet metal. Housing 10 has an open bottom 12 permitting access to an interior chamber 13 within housing 10. A flange 13 is formed around the open bottom of housing 10. A circular hinged door 14 has a circular window 16 made of a transparent material. The unhinged end of door 14 has a captive thumb or Allen head screw 15 with a knurled head that engages a threaded opening 17 in flange 13. Because of the hinged design of door 14 and screws 15, which are manually rotatable, a maintenance person can gain access to the interior of housing 10 to service the luminaire with one hand and without tools. A reflector assembly 20 is attached to flange 13 by dart clips 34 (e.g., three in number) to cover the bottom of chamber 12. Dart clips 34 fit in holes (three in number) in flange 13. (See attached Exhibit A to provisional application Ser. No. 60/496,433, which is an information sheet of Plastics, LLC for a further description of the dart clips.) Specifically, reflector assembly 20 has a conventional reflector 22, a skirt 24 around reflector 22, and a socket (not shown) for receiving a lamp (not shown). By way of example, the lamp could be a high intensity halide or sodium discharge lamp.

A removable electrical component assembly 30 resides in chamber 13. Component assembly 30 includes a ballast/transformer and a capacitor mounted on a carrier tray 32. Ballast hanging thumb screws 38 (two in number) are mounted on the inside of chamber 12. Carrier tray 32 has inverted keyhole shaped openings 36 (two in number) adapted to receive thumb screws 38 when the thumb grips thereof are in vertical position and to retain thumb screws 32 when the thumb grips thereof are in a horizontal position.

A horizontal arm assembly 50 is bolted to housing 10 and connects it to a horizontal mounting pole (not shown). In addition to support, arm 50 serves as conduit for electricity to power the lighting fixture. A quick connect coupling 40 extends between arm 50 and the electrical components on carrier tray 32. A quick connect coupling 42 extends between the electrical components on carrier 32 and the socket that receives lamp. This permits quick connection and disconnection of component assembly 30 with a simple translational motion. (See attached Exhibit B for a description of the quick connect couplings.)

To change out an electrical component, such as the ballast, a maintenance person performs the following steps in the order recited:

1. Loosen thumb screw 15.
2. Swing open door 14 on its hinge.
3. Remove the lamp and snap reflector 20 off dart clips 34 to free up reflector 20 and expose carrier tray 32.
4. Disconnect quick connect coupling 42 between socket 26 and carrier tray 42 and the quick connect coupling 40 between carrier tray 42 and support arm 50.
5. Turn thumb screws 38 to a vertical position and lift carrier tray 32 up and out of chamber 12.
6. Install a new carrier tray by placing it down on thumb screws 38 and then turning thumb screws 38 to a horizontal position.
7. Repeat steps 4 to 1 in reverse order.

In summary a maintenance person without tools can accomplish the exchange simply and quickly without tools while the luminaire remains in place on the pole.

What is claimed is:

1. An improved luminaire comprising:

a housing having an interior wall;

a door permitting access to the interior wall of the housing when open;

a reflector assembly in the housing for receiving a lamp;

a carrier tray;

a transformer and a capacitor mounted on the carrier tray; and a rotatable fastener and an opening designed so the fastener is able to pass through the opening in an unlocked rotational position and is unable to pass through the opening in a locked rotational position, the fastener being on one of the tray or the interior wall and the opening being on the other of the tray or the interior wall, thereby locking and unlocking the tray to the interior wall as the fastener is rotated from one position to the other.

2. The luminaire of claim 1, in which the fastener comprises a pair of thumb screws in the housing and the opening comprises a pair of inverted keyhole shaped openings in the carrier adapted to receive the thumb screws.

3. The luminaire of claim 2, in which the thumb screws are adapted to secure the carrier with a one quarter turn.

4. The luminaire of claim 3, in which the door is hinged so it hangs down when open.

5. The luminaire of claim 4, additionally comprising a manually rotatable screw for securing the door when it is closed.

6. The luminaire of claim 1, in which the door is hinged so it hangs down when open.

7. The luminaire of claim 6, additionally comprising a manually rotatable screw for securing the door when it is closed.

8. The luminaire of claim 1, additionally comprising a manually rotatable screw for securing the door when it is closed.

9. A method for changing out components in the luminaire of claim 1 comprising:

opening the door to gain access to the interior of the housing;

rotating the fastener from a closed position to an open position;

replacing the carrier tray; and rotating the fastener from an open position to a closed position; and closing the door.

10. The method of claim 9, additionally comprising removing the reflector assembly from the housing before rotating the fastener from a closed position to an open position.

* * * * *